US009246256B2

(12) United States Patent
Sasaki et al.

(10) Patent No.: US 9,246,256 B2
(45) Date of Patent: Jan. 26, 2016

(54) TERMINAL COVER

(71) Applicant: PANASONIC INTELLECTUAL PROPERTY MANAGEMENT CO., LTD., Osaka (JP)

(72) Inventors: Tomoaki Sasaki, Mie (JP); Yasuhiro Sumino, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/537,053

(22) Filed: Nov. 10, 2014

(65) Prior Publication Data

US 2015/0133006 A1 May 14, 2015

(30) Foreign Application Priority Data

Nov. 11, 2013 (JP) ..... 2013-233300

(51) Int. Cl.
*H01R 9/22* (2006.01)
*H01R 13/447* (2006.01)
*H01R 9/24* (2006.01)

(52) U.S. Cl.
CPC ..... *H01R 13/447* (2013.01); *H01R 9/2475* (2013.01)

(58) Field of Classification Search
CPC ..... H01R 9/24; H01R 9/2675; H01R 9/223; H01R 3/34; H01R 4/36; H01R 4/363; H01R 4/301; H01R 23/7073; H01R 4/70
USPC ..... 439/709, 712, 715, 718, 724, 801, 439/810–814, 892; 174/138 F; 335/132
See application file for complete search history.

(56) References Cited

U.S. PATENT DOCUMENTS 4,254,316 A * 3/1981 Landow ..... H01H 9/182 200/308
4,899,120 A * 2/1990 Ohtake ..... H01H 9/0264 335/132

(Continued)

FOREIGN PATENT DOCUMENTS

JP 62-195863 8/1987
JP 63-63974 4/1988

(Continued)

OTHER PUBLICATIONS

Office Action issued in Korea Counterpart Patent Appl. No. 10-2014-0155551, dated Dec. 11, 2015, along with an English translation thereof.

*Primary Examiner* — Thanh Tam Le
(74) *Attorney, Agent, or Firm* — Greenblum & Bernstein, P.L.C.

(57) ABSTRACT

A terminal cover is capable of improving the workability. The terminal device includes a first cover portion to be positioned above the first screw terminals, wherein the first cover portion including the first operation openings which respectively expose screws of the first screw terminals, a second cover portion to be positioned above the second screw terminals, the second cover portion including the second operation openings which respectively expose screws of the second screw terminals. And the terminal device further includes a connecting portion connecting the first cover portion with the second cover portion and including wire insertion holes through which electric wires connected to the first screw terminals respectively pass and wire insertion paths which communicate with the wire insertion holes and through which the electric wires respectively pass, each insertion path being provided on an upper surface of the second cover portion between two adjacent second operation openings.

16 Claims, 9 Drawing Sheets

(56) References Cited

U.S. PATENT DOCUMENTS 5,347,250 A * 9/1994 Muske ..... H01H 49/00 335/132
5,407,367 A * 4/1995 Robertson ..... H01R 12/515 439/715
6,176,747 B1 * 1/2001 Rowe ..... H01R 9/2491 439/701
6,238,234 B1 * 5/2001 Sedlecky ..... H01R 9/2491 439/412
6,630,626 B2 * 10/2003 Johnson ..... H01R 13/447 174/138 F
6,793,519 B2 * 9/2004 Otsuka ..... H01R 9/2425 439/395
7,134,921 B2 * 11/2006 Siracki ..... H01R 4/305 439/718
8,113,864 B2 * 2/2012 Chiang ..... H01R 13/4361 439/347
8,932,089 B2 * 1/2015 Grunwald ..... H01R 4/36 439/814
2005/0164564 A1 * 7/2005 Kawata ..... H01H 1/5855 439/793
2006/0228950 A1 * 10/2006 Jamaleddin ..... H01R 9/223 439/709

FOREIGN PATENT DOCUMENTS

JP 2002-163973 6/2002
JP 2006-260829 9/2006
JP 2006-331889 12/2006
JP 2012-59678 3/2012

* cited by examiner

TERMINAL COVER

CROSS-REFERENCE TO RELATED APPLICATIONS

This application claims priority to Japanese Patent Application No. 2013-233300 filed on Nov. 11, 2013, the entire contents of which are incorporated herein by reference.

TECHNICAL FIELD

The present invention disclosure to a terminal cover and, more particularly, to a terminal cover which is attached to a terminal device having screw terminals arranged in upper and lower steps of a stepped portion.

BACKGROUND ART

In the related art, there is provided a terminal cover which is attached to a terminal device having screw terminals arranged in upper and lower steps of a stepped portion (see, e.g., Japanese Patent Application Publication No. S62-195863).

A terminal device will be described in detail by taking a relay 1 shown in FIGS. 8 to 10 as an example. The relay 1 includes a housing 2 which is fixed such that one surface (hereinafter referred to as "lower surface") of the housing 2 faces toward a fixing target (not shown) such as a distribution board or the like. The housing 2 is made of, e.g., a synthetic resin. The housing 2 has a rectangular shape when viewed at the upper side thereof (at the opposite side to the fixing target). In the vicinity of one end (hereinafter referred to as "front end") of the housing 2 in a long side direction of the upper surface (hereinafter referred to as a "front-rear direction"), there is provided a stepped portion including an upper step 21 and a lower step 22 which extend along the front end and are provided side by side in the front-rear direction. In the stepped portion, the low step 22 (close to the front end) is more depressed than the upper step 21 (distant from the front end) (In other words, the lower step 22 is smaller in upward protrusion dimension than the upper step 21).

At the upper step 21 and lower step 22, a plurality of (four, in the drawings) screw terminals 31 and a plurality of (four, in the drawings) screw terminals 32 are respectively arranged side by side in a short side direction (hereinafter referred to as "left-right direction") of the housing 2 along each steps of the stepped portion 21 and 22. In each of the screw terminals 31 and 32, the axial direction of a screw is oriented in an up-down direction and the head portion of the screw is directed upward.

Two screw terminals (hereinafter referred to as "signal terminals") 33, to which signal lines are connected, are arranged in the rear end portion of the relay 1. In the housing 2 of the relay 1, there is accommodated a switching unit (not shown) which turns on and off the electric conduction between the upper screw terminals 31 of the upper step 21 and the lower screw terminals 32 of the lower step 22 in response to an electric signal inputted to the signal terminals 33. The switching unit may be a mechanical contact point driven by an electromagnet, a semiconductor switch, or the combination of the mechanical contact point and the semiconductor switch which are connected to each other in parallel.

On the upper surface of the housing 2, there are provided partitions 231, 232 and 233 which divide the screw terminals 31, 32 and 33 arranged side by side in the short side direction and a pair of sidewalls 24 which interposes all the screw terminals 31 and 32 arranged at the front end side (i.e., except for the signal terminals 33).

In the aforementioned relay 1, as shown in FIG. 10, it is sometimes the case that electric wires 41 connected to the upper screw terminals (hereinafter referred to as "first screw terminals") 31 of the upper step 21 of the stepped portion are positioned above the lower screw terminals (hereinafter referred to as "second screw terminals") 32 of the lower step 22 of the stepped portion. In this case, when electric wires 42 are attached or detached by operating the second screw terminals 32, the electric wires 41 connected to the first screw terminals 31 become obstacles, thereby impairing the workability.

The conventional terminal cover is not designed to solve the aforementioned problem and is not capable of improving the workability.

SUMMARY OF THE INVENTION

In view of the above, the present disclosure provides a terminal cover capable of improving the workability.

In accordance with the present invention, there is provided a terminal cover to be attached to a terminal device which is fixed to a fixing target with a lower surface thereof facing toward the fixing target, the terminal device including a housing having a stepped portion which extends along an end of an upper surface of the terminal device and a lower step of which is closer to the end than an upper step of the stepped portion, a plurality of first screw terminals installed in the upper step and arranged parallel to the side and a plurality of second screw terminals installed in the lower step and arranged parallel to the side, the terminal cover including: a first cover portion to be positioned above the first screw terminals, wherein the first cover portion including a plurality of first operation openings which respectively expose screws of the first screw terminals; a second cover portion to be positioned above the second screw terminals, the second cover portion including a plurality of second operation openings which respectively expose screws of the second screw terminals; a connecting portion connecting the first cover portion with the second cover portion, the connecting portion including wire insertion holes through which electric wires connected to the first screw terminals respectively pass; and wire insertion paths which communicate with the wire insertion holes and through which the electric wires respectively pass, each insertion path being provided on an upper surface of the second cover portion between two adjacent second operation openings.

In the above terminal cover, further includes partition portions, each of which is to be positioned between electric wires connected to the second screw terminals adjacent to each other.

In the above terminal cover, the second cover portion includes a flat plate and guide protrusion portions protruding upward from an upper surface of the flat plate to define the second operation openings, and the wire insertion paths are provided between two adjacent guide protrusion portions.

In the above terminal cover, a depth dimension of the wire insertion paths is twice or more as large as a diameter of the electric wires connected to the first screw terminals.

In the above terminal cover, an upper surface of the second cover portion is inclined downward toward the connecting portion.

According to the present invention, the electric wires connected to the first screw terminals and drawn from the wire insertion holes pass through the wire insertion grooves existing between the second operation-purpose openings. Thus, the electric wires are hardly positioned above the second operation-purpose openings. Accordingly, the electric wires are hard to become obstacles when operating the screw terminals. This helps improve the workability.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Figure 1:
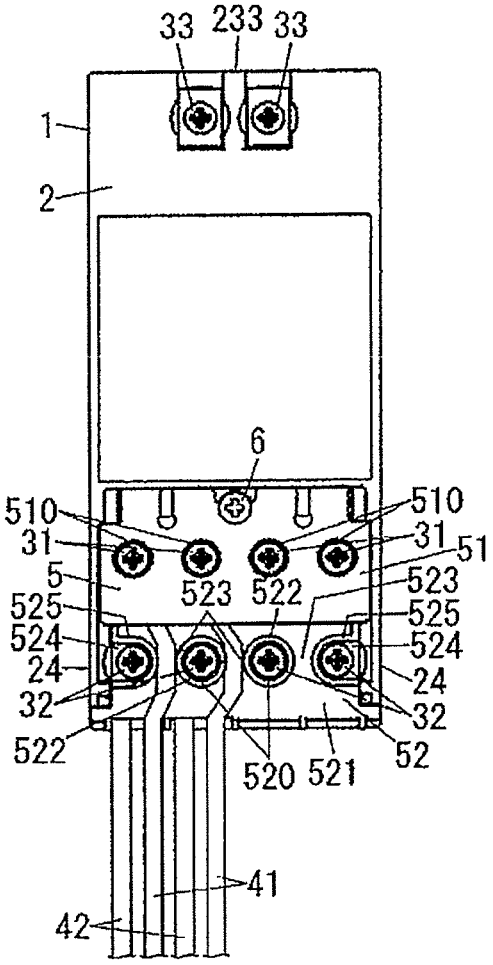
FIG. 1 is a plan view showing a state in which electric wires are connected to a relay to which a terminal cover according to one embodiment of the present invention is attached.

The present invention is directed to a terminal cover 5 attached to a terminal device (relay 1) which is fixed to a fixing target with the lower surface thereof facing toward the fixing target. The terminal device (relay 1) includes a housing 2 having a stepped portion including an upper step 21 and a lower step 22 which extends along an end of an upper surface of the terminal device. The lower step 22 is closer to the end than the upper step 21. The terminal device (relay 1) further includes a plurality of first screw terminals 31 installed in the upper step 21 of the stepped portion and arranged side by side along the upper step 21 and a plurality of second screw terminals 32 installed in the lower step 22 and arranged side by side along the lower step 22. The terminal cover 5 includes a first cover portion 51 positioned above the first screw terminals 31, a second cover portion 52 positioned above the second screw terminals 32, and a connecting portion 53 disposed between the first cover portion 51 and the second cover portion 52.

The first cover portion 51 includes a plurality of first operation openings 510 which expose screws of the first screw terminals 31, one screw in each opening. The second cover portion 52 includes a plurality of second operation openings 520 and 524 which expose screws of the second screw terminals 32, one screw in each opening. The connecting portion 53 includes wire insertion holes 530 through which electric wires 41 connected to the first screw terminals 31 pass. Wire insertion paths 523 which communicate with the wire insertion holes 530 and through which the electric wires 41 pass are defined between the second operation openings 520 and 524 on an upper surface of the second cover portion 52.

Preferably, the terminal cover 5 may further include partition portions (leg portions 54), each of which is positioned between electric wires 42 connected to the second screw terminals 32 adjacent to each other.

In the terminal cover 5, the second cover portion 52 may include a flat body portion 521 and guide protrusion portions 522 and 525 protruding upward from an upper surface of the body portion 521 along edges of the second operation openings 520 and 524. The wire insertion paths 523 may be defined between the guide protrusion portions 522 and 525.

In the terminal cover 5, a depth dimension of the wire insertion paths 523 is preferably twice or more as large as a diameter of the electric wires 41 connected to the first screw terminals 31.

In the terminal cover 5, the upper end surface of the second cover portion 52 is preferably inclined downward toward the connecting portion 53.

A best mode for carrying out the present invention will now be described with reference to the accompanying drawings.

Figure 2:
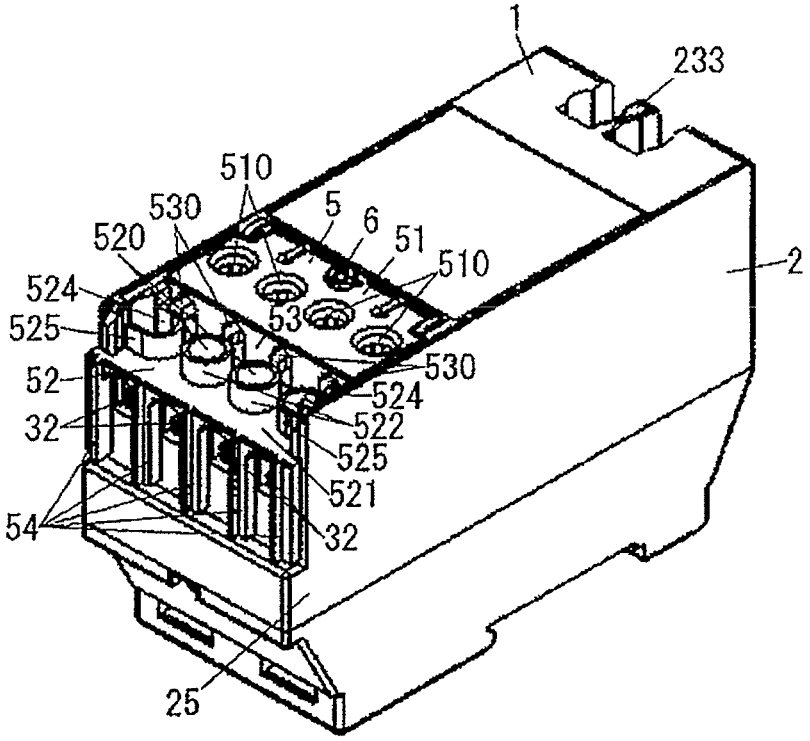
FIG. 2 is a perspective view showing the relay to which the terminal cover is attached.
Figure 3:
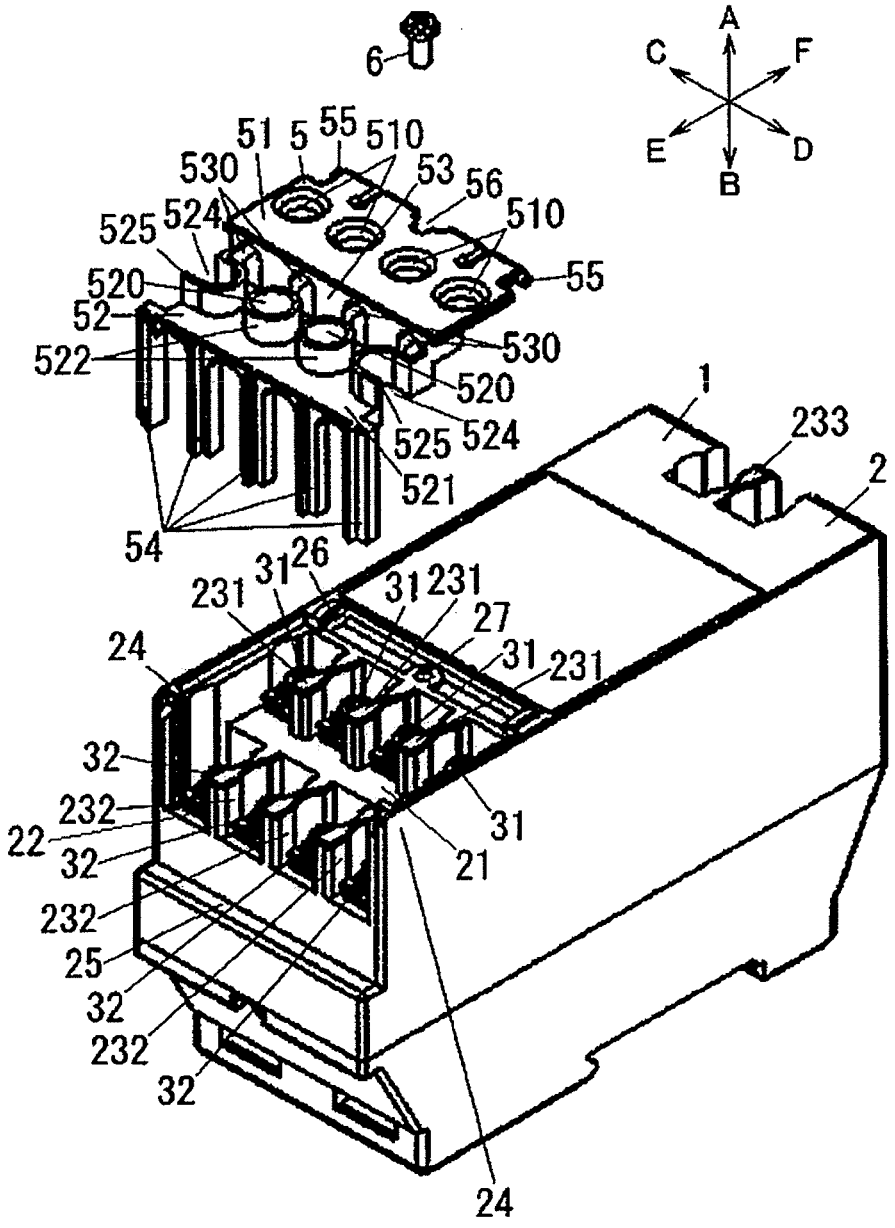
FIG. 3 is a perspective view showing the terminal cover and the relay.
Figure 8:
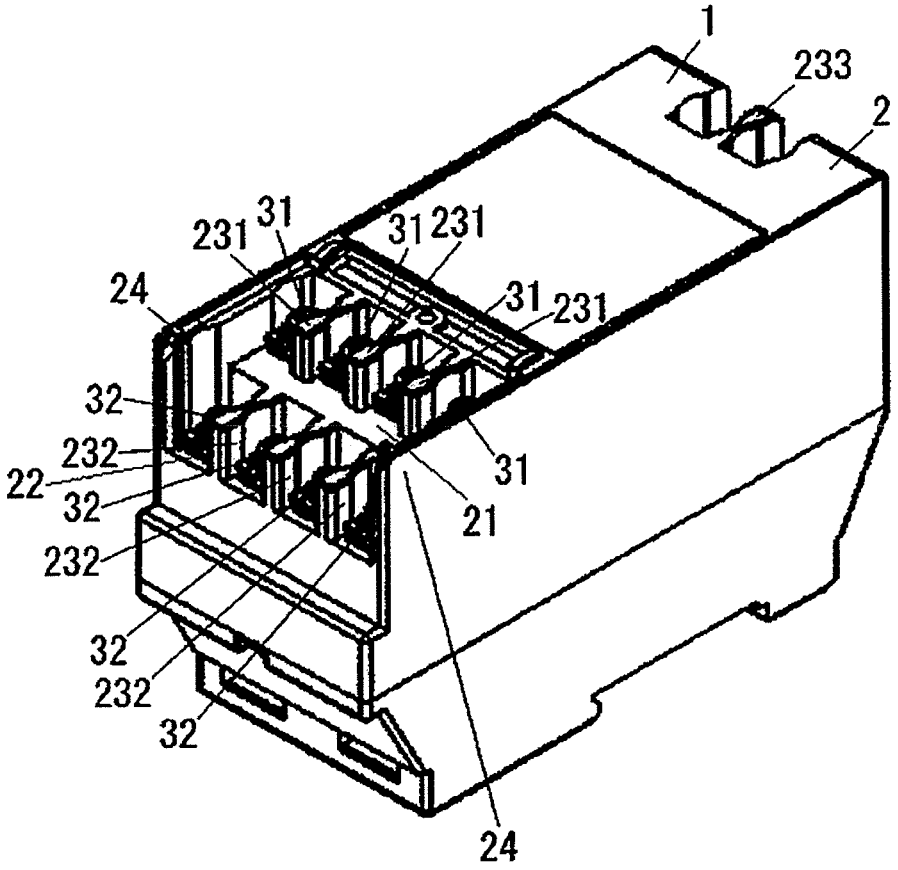
FIG. 8 (RELATED ART)
FIG. 8 is a perspective view showing a relay.
Figure 9:
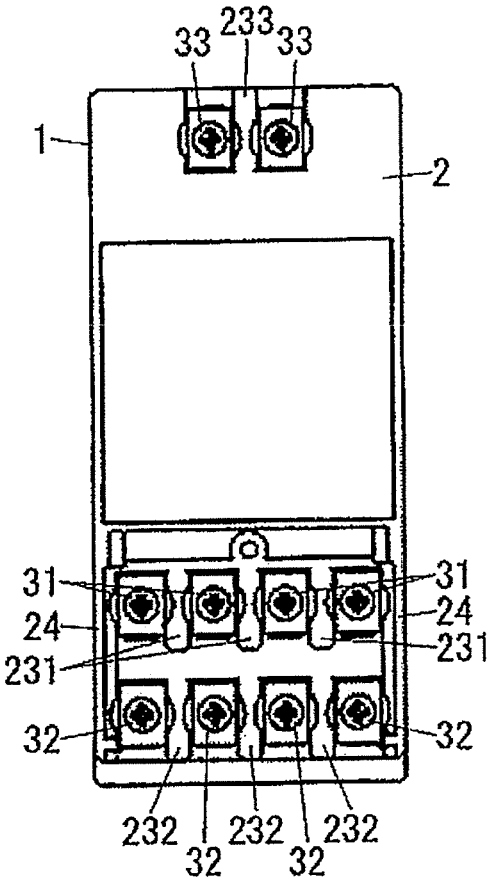
FIG. 9 (RELATED ART)
FIG. 9 is a plan view of the relay.
Figure 10:
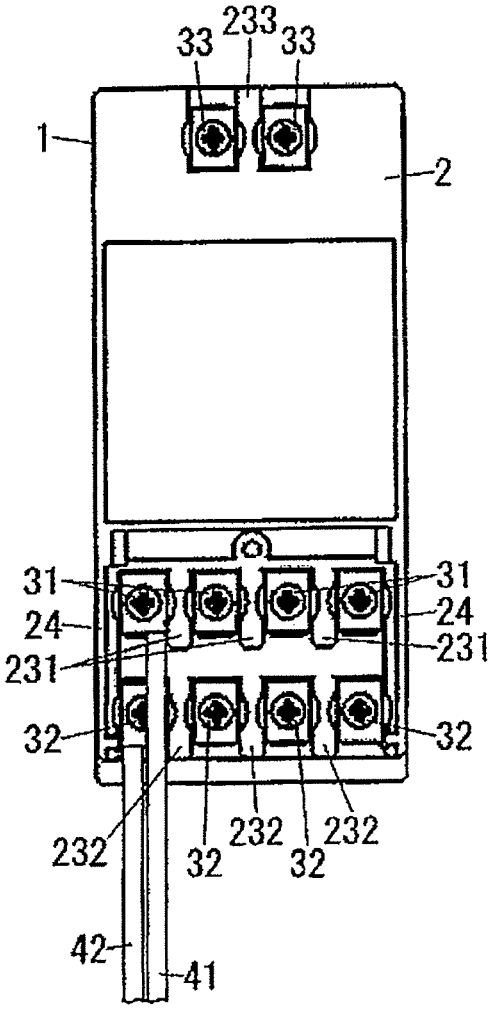
FIG. 10 (RELATED ART)
FIG. 10 is a plan view showing a state in which electric wires are connected to the relay.

As shown in FIGS. 1 to 3, the terminal cover 5 of the present embodiment is attached to a relay 1 as the terminal device described with reference to FIGS. 8 to 10. The terminal cover 5 is made of an insulating material such as, e.g., a synthetic resin or the like. The terminal cover 5 prevents a human finger from making contact with the screw terminals 31 and 32, thereby preventing electric shock.

In the following description, the definitions of directions are the same as those described in respect of the related art. That is to say, the AB direction in FIG. 3 is defined as an up-down direction. The CD direction in FIG. 3 (the left-right direction in FIG. 1) is defined as a left-right direction. The EF direction in FIG. 3 (the up-down direction in FIG. 1) is defined as a front-rear direction. The aforementioned directions are defined for the sake of convenience in description and are not necessarily coincident with the directions in an actual use condition.

The terminal cover 5 includes a first cover portion 51 mounted on partitions 231 provided between first screw terminals 31, a second cover portion 52 mounted on partitions 232 provided between second screw terminals 32, and a connecting portion 53 connected to the front end of the first cover portion 51 and connected to the rear end of the second cover portion 52.

In the first cover portion 51, first operation openings 510 as circular through-holes which expose head portions of screws of the first screw terminals 31, one head portion in each opening, are formed in the same number as the first screw terminals 31 (four, in the drawings). That is to say, even when the terminal cover 5 is attached in place, each of the first screw terminals 31 can be driven by a screwdriver (not shown) inserted into each of the first operation openings 510 from above.

In the second cover portion 52, second operation openings 520 and 524 which expose head portions of screws of the second screw terminals 32 upward, one head portion in each opening, are formed in the same number as the second screw terminals 32 (four, in the drawings). Two second operation openings 520 located at the middle are formed of circular through-holes extending in the up-down direction. Two second operation openings 524 located at the left and right ends are formed of grooves opened outward in the left-right direction and opened upward and downward. That is to say, even when the terminal cover 5 is attached in place, each of the second screw terminals 32 can be driven by a screwdriver (not shown) inserted into each of the second operation openings 520 and 524 from above.

In the connecting portion 53, wire insertion holes 530 through which electric wires 41 connected to the first screw terminals 31 pass are formed in the same number as the first screw terminals 31 (four, in the drawings).

In the relay 1, a protrusion portion 25 is formed on the front end surface of the housing 2. The terminal cover includes a plurality of (five, in the drawings) leg portions 54 protruding downward from the front end of the second cover portion 52 with the tip (the lower end) thereof mounted on the upper surface of the protrusion portion 25. The respective leg portions 54 are arranged in such positions as to avoid the front sides of the second screw terminals 32. The electric wires 42 connected to the second screw terminals 32 are drawn frontward through the gaps between the leg portions 54. That is to say, the leg portions 54, except for the leg portions 54 located at the opposite lateral ends, (three leg portions 54 in the drawings) serve as partition portions that exist between the electric wires 42 connected to the second screw terminals 32 adjacent to each other.

On the left and right surfaces of the rear end portion of the first cover portion 51, there are provided cylindrical columnar shaft protrusion portions 55 whose axes extend in the left-right direction. In the housing 2 of the relay 1, there are provided two bearing holes 26 (only one of which is shown) into which the shaft protrusion portions 55 are respectively inserted. That is to say, if the shaft protrusion portions 55 are respectively inserted into the bearing holes 26, the terminal cover 5 is coupled to the housing 2 of the relay 1 so as to rotate about the center axis of the shaft protrusion portions 55. The rotatable extent of the terminal cover 5 is from a closed position where the respective cover portions 51 and 52 are positioned above the corresponding screw terminals 31 and 32 as shown in FIG. 2 to an open position where the terminal cover 5 is rotated (90 degrees clockwise when viewed from the right side) such that the front end of the terminal cover 5 is directed upward.

In the central portion of the rear edge of the first cover portion 51, there is provided a screw insertion recess portion 56 opened rearward, upward and downward. On the upper surface of the housing 2 of the relay 1, a screw hole is provided in a position corresponding to the screw insertion recess portion 56. That is to say, the terminal cover 5 is fixed to the housing 2 of the relay 1 by a screw inserted into the screw hole 27 through the screw insertion recess portion 56, whereby the terminal cover 5 is prevented from rotating from the closed position to the open position.

Description will now be made on the features of the present invention parts.

The second cover portion 52 includes a flat body portion 521 whose thickness direction extends in the up-down direction, and guide protrusion portions 522 and 525 protruding upward from the upper surface of the body portion 521 to define the second operation openings 520 and 524. Two guide protrusion portions 522 located at the middle have a cylindrical shape. Two guide protrusion portions 525 located at the left and right ends have a U-shaped section opened outward in the left-right direction and opened in the up-down direction. When the terminal cover 5 is in the closed position, the left and right outer openings of two guide protrusion portions 525 located at the left and right ends are closed by the sidewalls 24 of the housing 2 of the relay 1. In other words, two guide protrusion portions 525 located at the left and right ends form tube shapes together with the sidewalls 24.

The distance between the guide protrusion portions 522 and 525 and the distance between each of the guide protrusion portions 522 and 525 and the connecting portion 53 are larger than the diameter of the electric wires 41 and 42. Thus, wire insertion paths 523 communicating with the wire insertion holes 530 at the rear end thereof are formed between the guide protrusion portions 522 and 525 adjacent to each other.

The upper ends of the respective guide protrusion portions 522 are positioned higher than the upper ends of the wire insertion holes 530. The electric wires 41 connected to the first screw terminals 31 and drawn from the wire insertion holes 530 are drawn frontward through the wire insertion paths 523.

With the configuration described above, the electric wires 41 connected to the first screw terminals 31 and drawn from the wire insertion holes 530 pass through the wire insertion paths 523 between the second operation openings 520 and 524. Therefore, the electric wires 41 are hardly positioned above the second operation openings 520 and 524.

As a result, the electric wires 41 are hard to become obstacles when operating the second screw terminals 32. This helps improve the workability.

Figure 4:
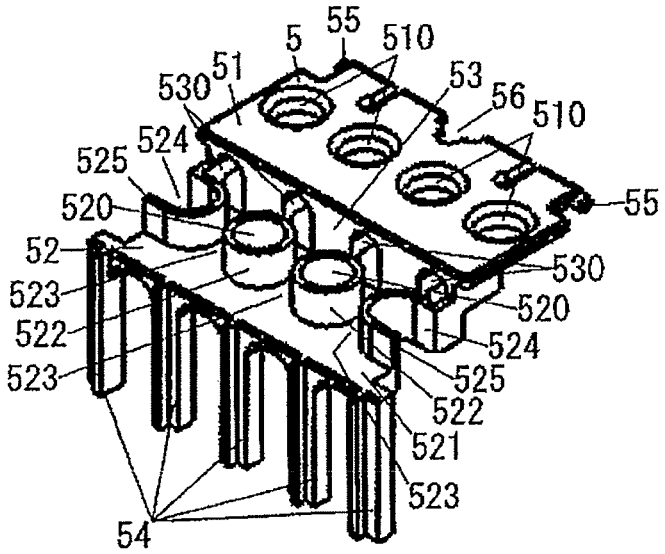
FIG. 4 is a perspective view showing the terminal cover.
Figure 5:
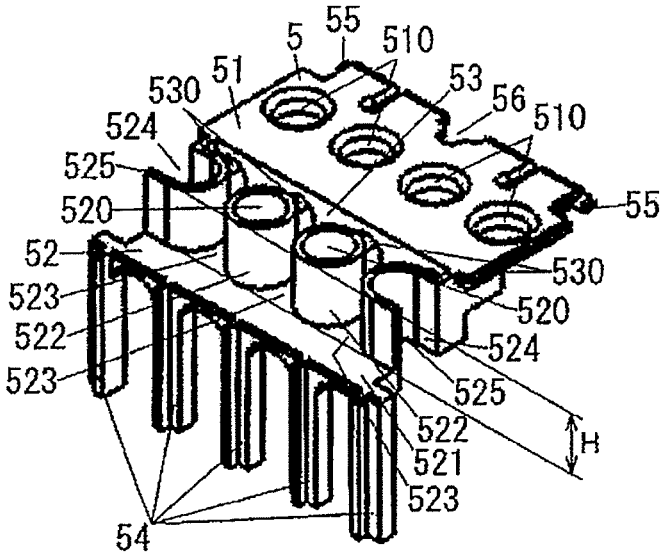
FIG. 5 is a perspective view showing a terminal cover according to a first modified example of the present invention.
Figure 6:
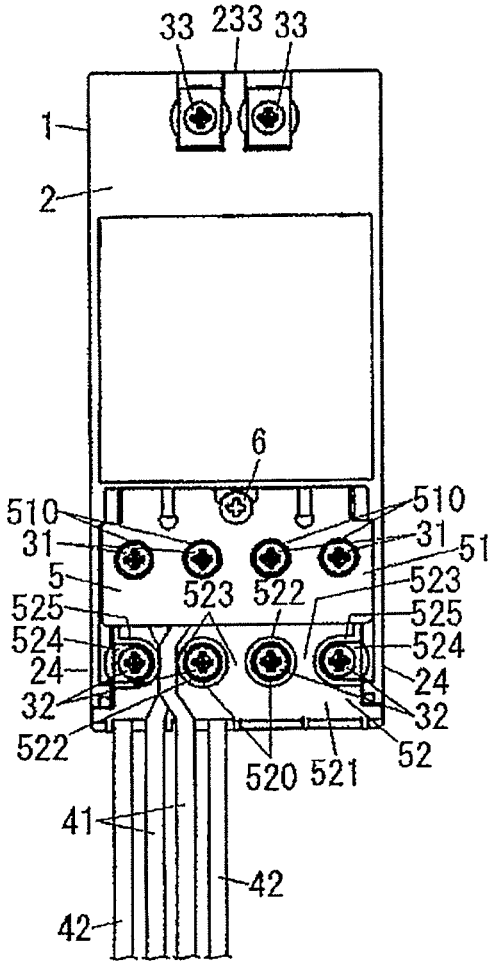
FIG. 6 is a plan view showing a state in which electric wires are connected a relay to which the terminal cover shown in FIG. 5 is mounted.

In the example described above, as shown in FIG. 4, the upper end surfaces of the guide protrusion portions 522 and 525 are positioned lower than the upper surface of the first cover portion 51. Alternatively, as shown in FIG. 5, the upper end surfaces of the guide protrusion portions 522 and 525 may be located on the same plane as the upper surface of the first cover portion 51. In particular, it is preferred that the depth dimension of the wire insertion paths 523 (i.e., the protrusion dimension of the guide protrusion portions 522 and 525 measured from the upper surface of the body portion 521) H is twice or more as large as the diameter of the electric wires 41 (the overall diameter including a core wire and an insulation coating). With this configuration, as shown in FIG. 6, two electric wires 41 can pass through one wire insertion paths 523 in an overlapped state in the up-down direction. This helps increase the degree of freedom in arranging the electric wires 41.

Figure 7:
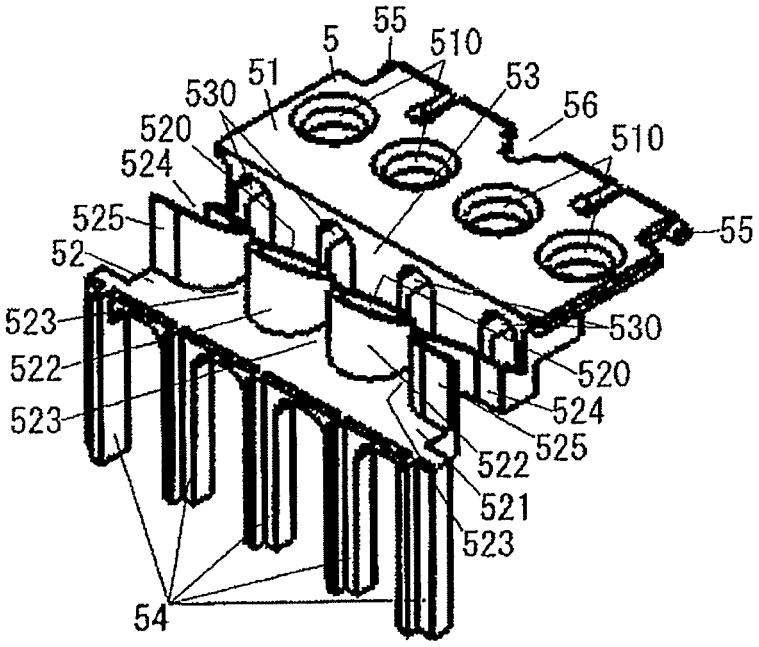
FIG. 7 is a perspective view showing a terminal cover according to a second modified example of the present invention.

As shown in FIG. 7, the upper end surface of the second cover portion 52 (i.e., the upper end surfaces of the guide protrusion portions 522) may be inclined downward toward the rear side (i.e., toward the connecting portion 53). With this configuration, it becomes relatively easy to introduce the electric wires 41 into the wire insertion holes 530.

While the invention has been shown and described with respect to the embodiments, it will be understood by those skilled in the art that various changes and modifications may be made without departing from the scope of the invention as defined in the following claims.

What is claimed is:

1. A terminal cover to be attached to a terminal device which is fixed to a fixing target with a lower surface thereof facing toward the fixing target, the terminal device including a housing having a stepped portion including an upper step and a lower step which extends along an end of an upper surface of the terminal device and the lower step which is closer to the end than the upper step, a plurality of first screw terminals installed in the upper step and arranged parallel to the end and a plurality of second screw terminals installed in the lower step and arranged parallel to the end, the terminal cover comprising:

a first cover portion to be positioned above the first screw terminals, wherein the first cover portion including a plurality of first operation openings which respectively expose screws of the first screw terminals;

a second cover portion to be positioned above the second screw terminals, the second cover portion including a plurality of second operation openings which respectively expose screws of the second screw terminals;

a connecting portion connecting the first cover portion with the second cover portion, the connecting portion including wire insertion holes through which electric wires connected to the first screw terminals respectively pass; and wire insertion paths which communicate with the wire insertion holes and through which the electric wires respectively pass, each insertion path being provided on an upper surface of the second cover portion between two adjacent second operation openings.

2. The terminal cover of claim 1, further comprising:

partition portions, each of which is to be positioned between electric wires connected to the second screw terminals adjacent to each other.

3. The terminal cover of claim 1, wherein the second cover portion includes a flat plate and guide protrusion portions protruding upward from an upper surface of the flat plate to define the second operation openings, and the wire insertion paths are provided between two adjacent guide protrusion portions.

4. The terminal cover of claim 1, wherein a depth dimension of the wire insertion paths is twice or more as large as a diameter of the electric wires connected to the first screw terminals.

5. The terminal cover of claim 1, wherein an upper surface of the second cover portion is inclined downward toward the connecting portion.

6. The terminal cover of claim 2, wherein the second cover portion includes a flat plate and guide protrusion portions protruding upward from an upper surface of the flat plate to define the second operation openings, and the wire insertion paths are provided between two adjacent guide protrusion portions.

7. The terminal cover of claim 2, wherein a depth dimension of the wire insertion paths is twice or more as large as a diameter of the electric wires connected to the first screw terminals.

8. The terminal cover of claim 3, wherein a depth dimension of the wire insertion paths is twice or more as large as a diameter of the electric wires connected to the first screw terminals.

9. The terminal cover of claim 6, wherein a depth dimension of the wire insertion paths is twice or more as large as a diameter of the electric wires connected to the first screw terminals.

10. The terminal cover of claim 2, wherein an upper surface of the second cover portion is inclined downward toward the connecting portion.

11. The terminal cover of claim 3, wherein an upper surface of the second cover portion is inclined downward toward the connecting portion.

12. The terminal cover of claim 4, wherein an upper surface of the second cover portion is inclined downward toward the connecting portion.

13. The terminal cover of claim 6, wherein an upper surface of the second cover portion is inclined downward toward the connecting portion.

14. The terminal cover of claim 7, wherein an upper surface of the second cover portion is inclined downward toward the connecting portion.

15. The terminal cover of claim 8, wherein an upper surface of the second cover portion is inclined downward toward the connecting portion.

16. The terminal cover of claim 9, wherein an upper surface of the second cover portion is inclined downward toward the connecting portion.

* * * * *